US011073158B2

(12) United States Patent
Hoehn

(10) Patent No.: US 11,073,158 B2
(45) Date of Patent: Jul. 27, 2021

(54) CENTRIFUGAL IMPELLER ASSEMBLY UNIT

(71) Applicant: Eugene Juanatas Hoehn, Tacoma, WA (US)

(72) Inventor: Eugene Juanatas Hoehn, Tacoma, WA (US)

( * ) Notice: Subject to any disclaimer, the term of this patent is extended or adjusted under 35 U.S.C. 154(b) by 0 days.

(21) Appl. No.: 16/443,301

(22) Filed: Jun. 17, 2019

(65) Prior Publication Data

US 2020/0256348 A1 Aug. 13, 2020

Related U.S. Application Data

(60) Provisional application No. 62/804,210, filed on Feb. 11, 2019.

(51) Int. Cl.

| | |
|---|---|
| ***F04D 29/22*** | (2006.01) |
| ***F04D 13/06*** | (2006.01) |
| ***F04D 1/00*** | (2006.01) |
| *B63H 21/17* | (2006.01) |
| *B63H 23/24* | (2006.01) |
| *B63H 5/125* | (2006.01) |
| *B63H 23/00* | (2006.01) |

(52) U.S. Cl.

CPC ..... *F04D 29/2216* (2013.01); *F04D 1/00* (2013.01); *F04D 13/06* (2013.01); *F04D 13/0646* (2013.01); *B63H 21/17* (2013.01); *B63H 23/24* (2013.01); *B63H 2005/1258* (2013.01); *B63H 2023/005* (2013.01)

(58) Field of Classification Search

CPC ..... F04D 29/2216; F04D 13/06; F04D 1/00; F04D 13/0646; B63H 2005/1258; B63H 2023/005; B63H 23/24; B63H 21/17

USPC ..... 417/420; 310/87

See application file for complete search history.

(56) References Cited

U.S. PATENT DOCUMENTS

| | | | | |
|---|---|---|---|---|
| 3,011,561 | A * | 12/1961 | Wagener | B63H 1/16 416/189 |
| 4,806,080 | A | 2/1989 | Mizobuchi et al. | |
| 5,306,183 | A * | 4/1994 | Holt | B63H 5/14 310/114 |
| 8,267,645 | B2 | 9/2012 | Brunner et al. | |
| 2007/0126297 | A1* | 6/2007 | de Zwart | B63H 1/16 310/86 |

(Continued)

OTHER PUBLICATIONS

Andersen, Thor Peter, Design of Rim Driven Waterjet Pump for Small Rescue Vessel, Jun. 2014, Chalmers University of Technology (Year: 2014).*

(Continued)

*Primary Examiner* — Connor J Tremarche

(74) *Attorney, Agent, or Firm* — Houda El-Jarrah; Bold IP, PLLC

(57) ABSTRACT

Embodiments are provided for a fluid pump having a hollow shaft centrifugal impeller capable of using suction or pressure to move large volume flows of fluids including liquids and gasses. In one or more non-limiting embodiments, the pump has an impeller assembly that is capable of being attached to the inner circumference of a housing tube and said housing tube is connected to a magnetic rotary. The magnetic rotary is capable of spinning the hollow shaft and the impeller assembly inside the hollow shaft and moving the fluid through the hollow shaft.

20 Claims, 7 Drawing Sheets

(56) References Cited

U.S. PATENT DOCUMENTS

| | | | | |
|---|---|---|---|---|
| 2008/0299845 | A1* | 12/2008 | Lewis | B63H 11/08 440/38 |
| 2009/0035122 | A1* | 2/2009 | Yagi | F04D 29/284 415/1 |
| 2011/0188928 | A1* | 8/2011 | West | B23P 11/00 403/291 |

OTHER PUBLICATIONS

Surtsey.org. Rim-Jet. [date accessed Nov. 13, 2018] http://www.surtsey.org/projects/rim-jet/.

* cited by examiner

CENTRIFUGAL IMPELLER ASSEMBLY UNIT

CROSS-REFERENCE TO RELATED APPLICATIONS

This application claims priority to U.S. Provisional Application No. 62/804,210 filed Feb. 11, 2019, which is incorporated by reference in its entirety.

FIELD OF THE DISCLOSURE

This disclosure relates generally to the field of mechanical fluid dynamics, and more particularly, system and apparatus for a pump having a hollow shaft centrifugal impeller.

BACKGROUND

Centrifugal impellers having a shaft and axial bladed devices are often used in pumps, compressors, fans, and blowers in order to move volumes of fluids such as gasses and liquids. Axial bladed devices are more traditionally used in thrusters and maritime engines because they are traditionally better at moving volumes of water with low-pressure changes.

However, traditional centrifugal impellers and axial bladed devices often require complex designs that are unreliable due to complex designs involving the axial shaft, are often large due to the need to include a large shaft and are prone to failures when ropes or other objects get wrapped around the shaft during operation.

There have been several attempts to solve the problems in the prior art, including the designs of axial hollow shaft bladed pumps and centrifugal impeller pumps. Although these pumps attempt to solve the problems of the traditional shaft, they introduce new problems including not having the expanded capabilities that a drive shaft provides for applying power for other uses besides fluid flow and not having the capabilities of both a centrifugal impeller device and an axial bladed device.

Due to all of the existing shortcomings in presently available devices, there is still a need for a fluid pump having a hollow shaft as described further below in the present description.

SUMMARY

The disclosure presented herein relates to a fluid pump having a hollow shaft centrifugal impeller that is capable of using suction or pressure to move large volume flows of fluids including liquids and gasses. In one or more non-limiting examples, the pump has an impeller assembly that is capable of being attached to the inner circumference of a housing tube and said housing tube is connected to a magnetic rotary. In this example, the magnetic rotary would spin the hollow shaft and the impeller assembly inside the hollow shaft and move the fluid through the hollow shaft. Those of ordinary skill will appreciate that other uses may be foreseeable also and are included within the scope of the present description.

In one aspect, one or more embodiments for providing an impeller assembly are provided in the present description, whereby the impeller assembly comprises an impeller that has a ring-shaped impeller hub with one or more impeller blades and a hollow shaft attached to the outside circumference of said impeller hub. Further, the present impeller assembly may comprise one or more spirally wrapped channels extending from a position radially outward at the impeller's inlet end to a position radially inward at the impeller's outlet end.

The preceding and following embodiments and descriptions are for illustrative purposes only and are not intended to limit the scope of this disclosure. Other aspects and advantages of this disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
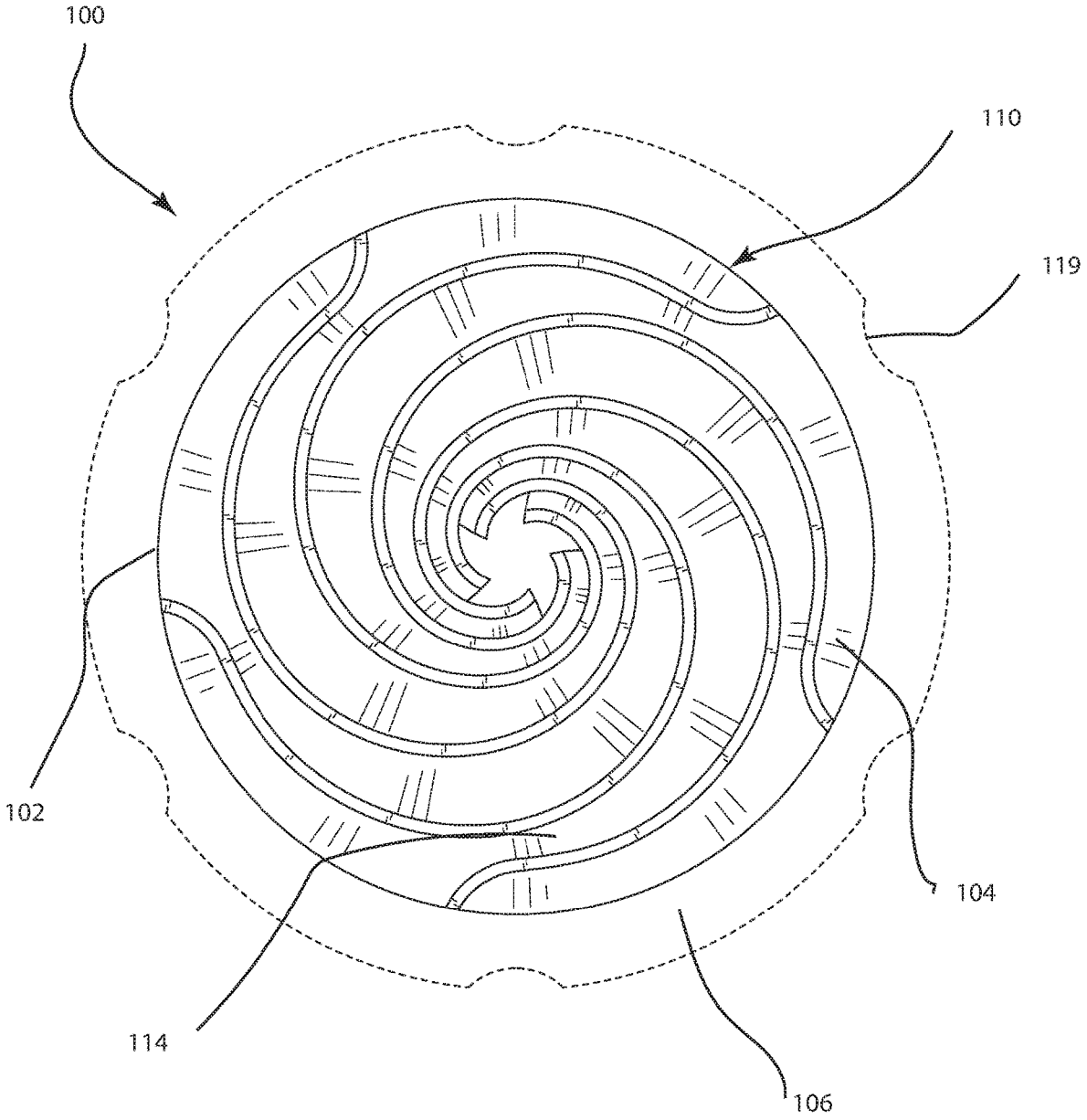
FIG. 1 is a front view of an exemplary impeller assembly according to various aspects of the present disclosure.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises", and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present description includes one or more embodiments for various fluid pumps that may be used to create suction to move volumes of fluids such as liquids or gasses. In one example, one or more embodiments of the various fluid pumps may be used for many purposes including fluid pumps for water, fuel, a wet and dry vacuum, a blower or thruster for commercial and military ships. In one or more non-limiting embodiments, a fluid pump may include a hollow shaft centrifugal impeller that is capable of using suction or pressure to move large volume flows of fluids including liquids and gasses. In one or more non-limiting examples, the fluid pump has an impeller assembly that is capable of being attached to the inner circumference of a housing tube and said housing tube is connected to a magnetic rotary. In this example, the magnetic rotary would spin the hollow shaft and the impeller assembly inside the hollow shaft, resulting in the movement of fluid through the hollow shaft. Elements included herein are meant to be illustrative, rather than restrictive. Persons having ordinary skill in the art relevant to the present disclosure may understand there to be equivalent elements that may be substituted with the present disclosure without changing the essential function or operation of the fluid pump.

Turning to FIG. 1, a top-down view of an exemplary impeller assembly 100 according to various aspects of the present disclosure is shown. This figure shows a centrifugal impeller 110 having an outer circumference 102. The centrifugal impeller 110 is shown with a hollow shaft 106 and one or more impeller blades 104.

In the embodiment of FIG. 1, centrifugal impeller 110 is shown being made up of an outer circumference that forms the outside surface of ring-shaped centrifugal impeller 110. Centrifugal impeller 110 is a rotating component of the fluid pump which transfers energy that drives the fluid pump to the fluid being pumped by accelerating the fluid outwards from the center of rotation. The centrifugal impeller, in one or more non-limiting embodiments, has an outer circumference 102 and an inner circumference. In this embodiment, connected to the inner circumference are impeller blades 104. As shown in the FIG. 1 embodiment, centrifugal impeller 110 is shown with five impeller blades. In further embodiments, the centrifugal impeller has one impeller blade or multiple impeller blades. In one or more non-limiting embodiments, the edge of the impeller blades forms a sharp wedge shape, allowing the impeller blades to cut through water.

Figure 3:
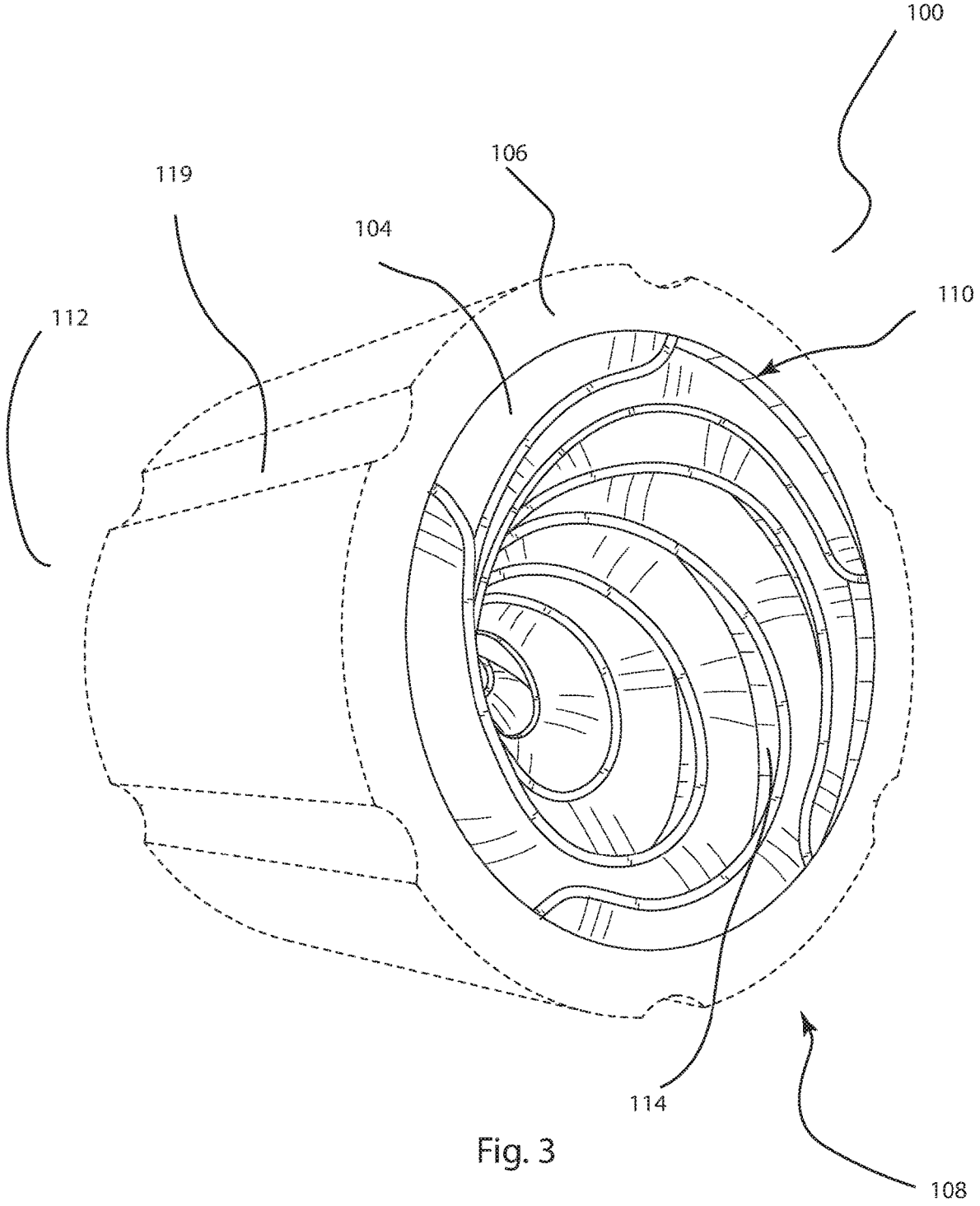
FIG. 3 is a perspective front view of the impeller assembly shown in FIG. 1.

Impeller blades 104, as shown in FIG. 1, are connected at one end to the inner circumference of the impeller hub and positioned radially outwardly at inlet end 108 (ash shown in FIG. 3) and extends radially inwardly to outlet end 112 (as shown in FIG. 3).

FIG. 1 also shows hollow shaft 106 that has an outer circumference and an inner circumference that is configured to fixedly attach to the outside circumference of impeller hub 110. In one or more non-limiting embodiments, the diameter of centrifugal impeller 110 is manufactured to a dimension to allow it to form a waterproof seal when fixedly attached to the inner circumference of hollow shaft 106. In one or more non-limiting embodiments, a water proofing sealant may be used to seal any cavity between the outer circumference of centrifugal impeller 110 and the inner circumference of hollow shaft 106. In a further embodiment, centrifugal impeller 110 and hollow shaft 106 are permanently attached.

In one or more non-limiting embodiments, when hollow shaft's 106 inner circumference is attached, or configured to be fixedly attached, to outside circumference 102 of centrifugal impeller 110, the combination of hollow shaft 106 and centrifugal impeller 110 forms impeller assembly 100. In this embodiment, said centrifugal assembly's outer circumference is the outer circumference of the hollow shaft.

Further, in the FIG. 1 view, one or more slots 119 located on hollow shaft 106 are shown. In the FIG. 1 embodiment, slots 119 extend the entire length of the outer circumference of the hollow shaft. In other embodiments, the slots extend a partial length of the outer circumference of the hollow shaft.

In one or more non-limiting embodiments, all parts of the impeller assembly or hollow shaft can be manufactured from various materials comprising: stainless steel, brass, bronze, carbon fiber, titanium, aluminum, various metal alloys, hard and soft nylon or plastics. In a further embodiment, if a plastic or non-magnetic metal embodiment is used, metal may be inserted, fastened, coupled, or otherwise connected or positioned into any part of the impeller assembly or hollow shaft as to allow it to rotate in a magnetic field.

Figure 2:
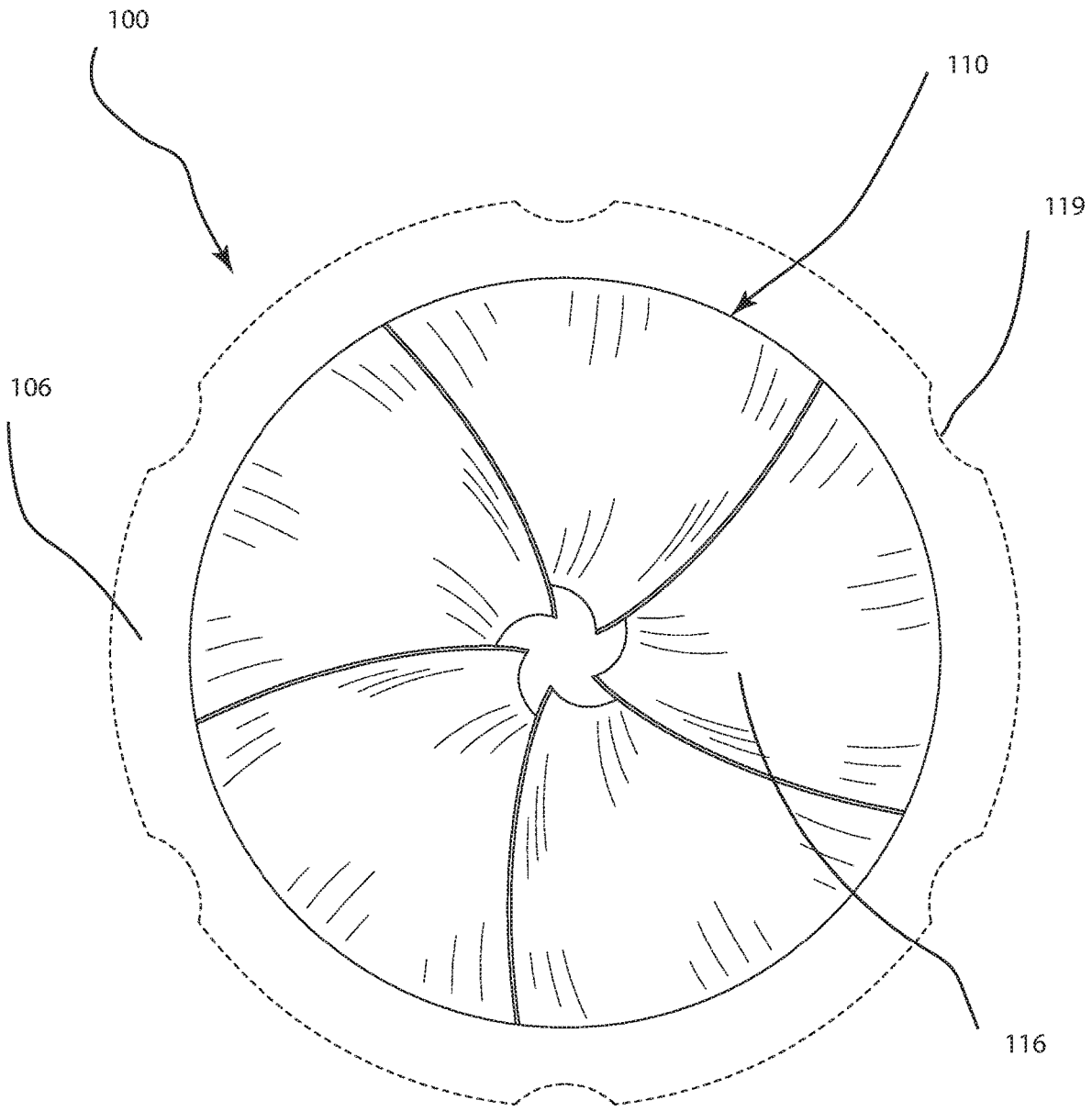
FIG. 2 is back of the impeller assembly shown in FIG. 1.

FIG. 2 is a bottom view of impeller assembly 100 shown in FIG. 1. In this embodiment, five outlet blades 116 are shown. In one or more non-limiting embodiments, the centrifugal impeller may have one outlet blade or multiple blades such as 100. In one or more non-limiting embodiments, outlet blades 116 are an extension and continuous piece of impeller blades 104. In another embodiment, the outlet blades are a separate blade, and attached separately, to centrifugal impeller 110 than the one or more impeller blades. Outlet blades 116 serve the purpose increasing the rate of the fluid that exits outlet end 112 (shown in FIG. 3) away from centrifugal impeller 110. In one or more non-limiting embodiments, this increased rate of fluid away from the centrifugal impeller creates thrust and propels the centrifugal impeller in the direction of the inlet end.

FIG. 3 is a perspective side view of impeller assembly 100 as shown in FIG. 1. In this view, centrifugal impeller 110, hollow shaft 106, impeller blades 104, slots 119, inlet end 108 and outlet end 112 are shown.

Impeller blades 104, as shown in FIG. 3, are connected at one end to the inner circumference of the impeller hub and positioned radially outwardly at inlet end 108 and extends radially inwardly to outlet end 112. In this embodiment impeller blades 104 form one or more spirally wrapped channels 114 in between impeller blades 104. In one or more non-limiting embodiments, spirally wrapped channels 114 are capable of compressing a fluid as it travels from inlet end 108 to outlet end 112 because the channels narrow in the direction of said outlet end, compressing the fluids. In one or more non-limiting embodiments channels may not just be spirally wrapped and have varying slopes/disjointed edges, noncongruent shapes.

In one or more non-limiting embodiments, inlet end 108 and outlet end 112 are substantially perpendicular to said inner and outer circumference. In one or more non-limiting embodiments, inlet end 108 is where fluids are suctioned into centrifugal impeller 110 when said impeller is rotating along an axis extending through the center of the inlet and outlet ends. Suction is created by the spiral spirally wrapped channels moving the fluid from inlet end 108 out outlet end 112. In a further embodiment, as the fluids are compressed in spirally wrapped channels 114, it is expelled through outlet end 112 at a faster rate than the fluid enters inlet end 108. In other non-limiting embodiments the exemplary impeller assembly 100 may instead thrust fluids in the reverse direction.

Figure 4:
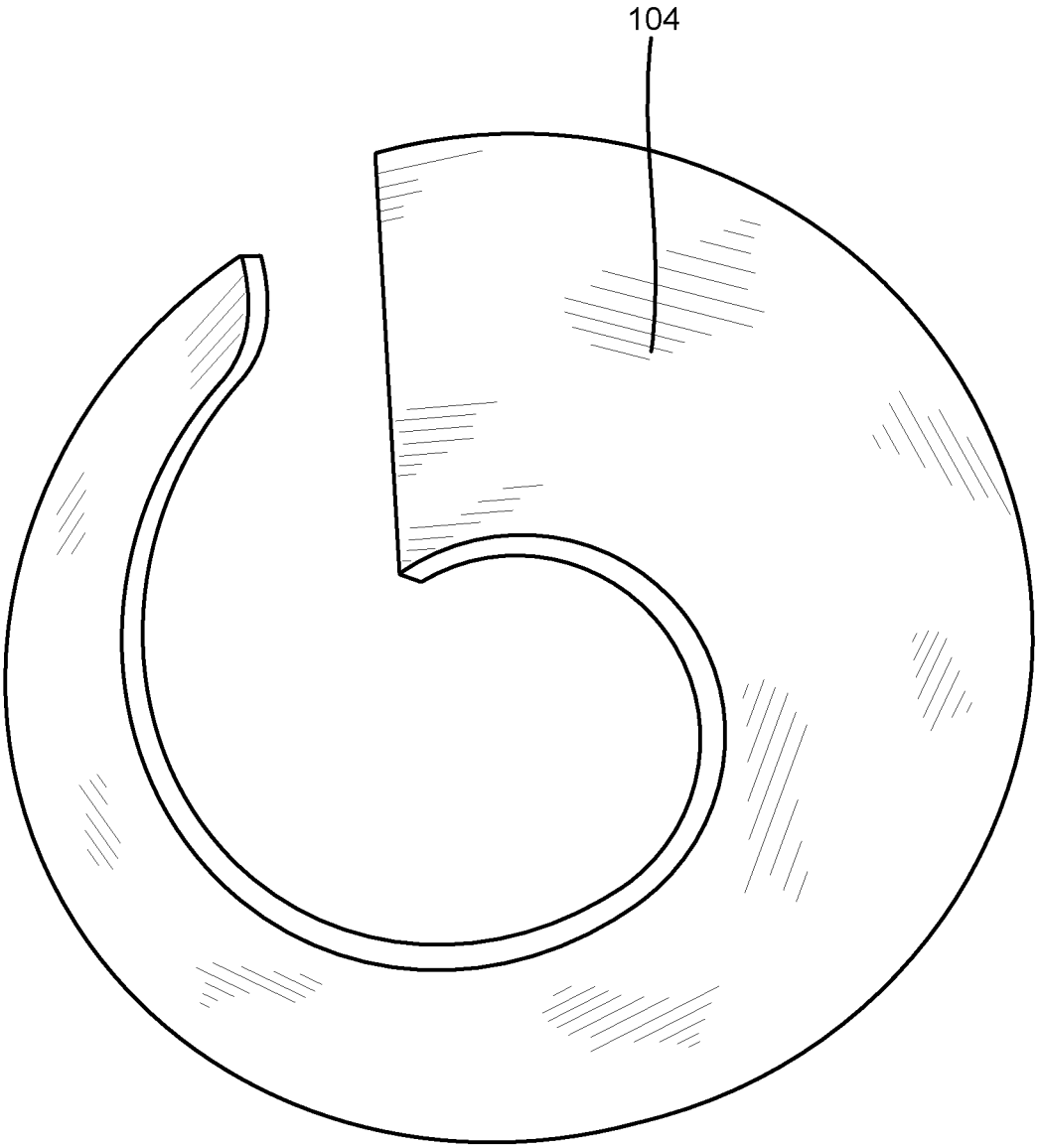
FIG. 4 is an isolated view of one of the blades of the impeller assembly as shown in FIG. 1.

FIG. 4 is an isolated view of one of the blades of the impeller assembly as shown in FIG. 1. In one non-limiting embodiment, this is an isolated view of the impeller blade to show the design of one of the blades.

Figure 5:
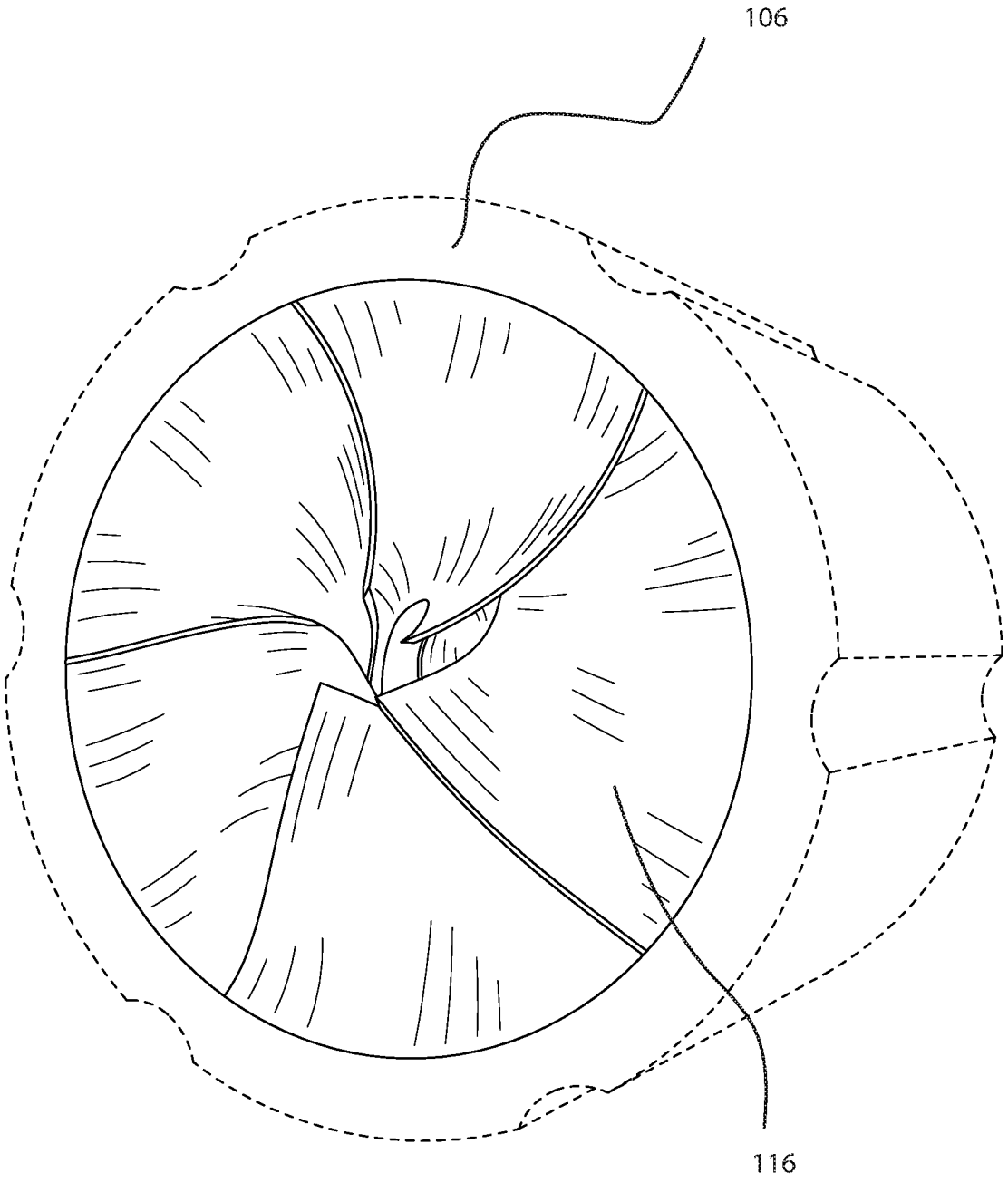
FIG. 5 is a perspective view back view of the impeller assembly shown in FIG.

FIG. 5 is a perspective view back view of the impeller assembly shown in FIG. 1. This view shows placement of five outlet blades 115.

Figure 6:
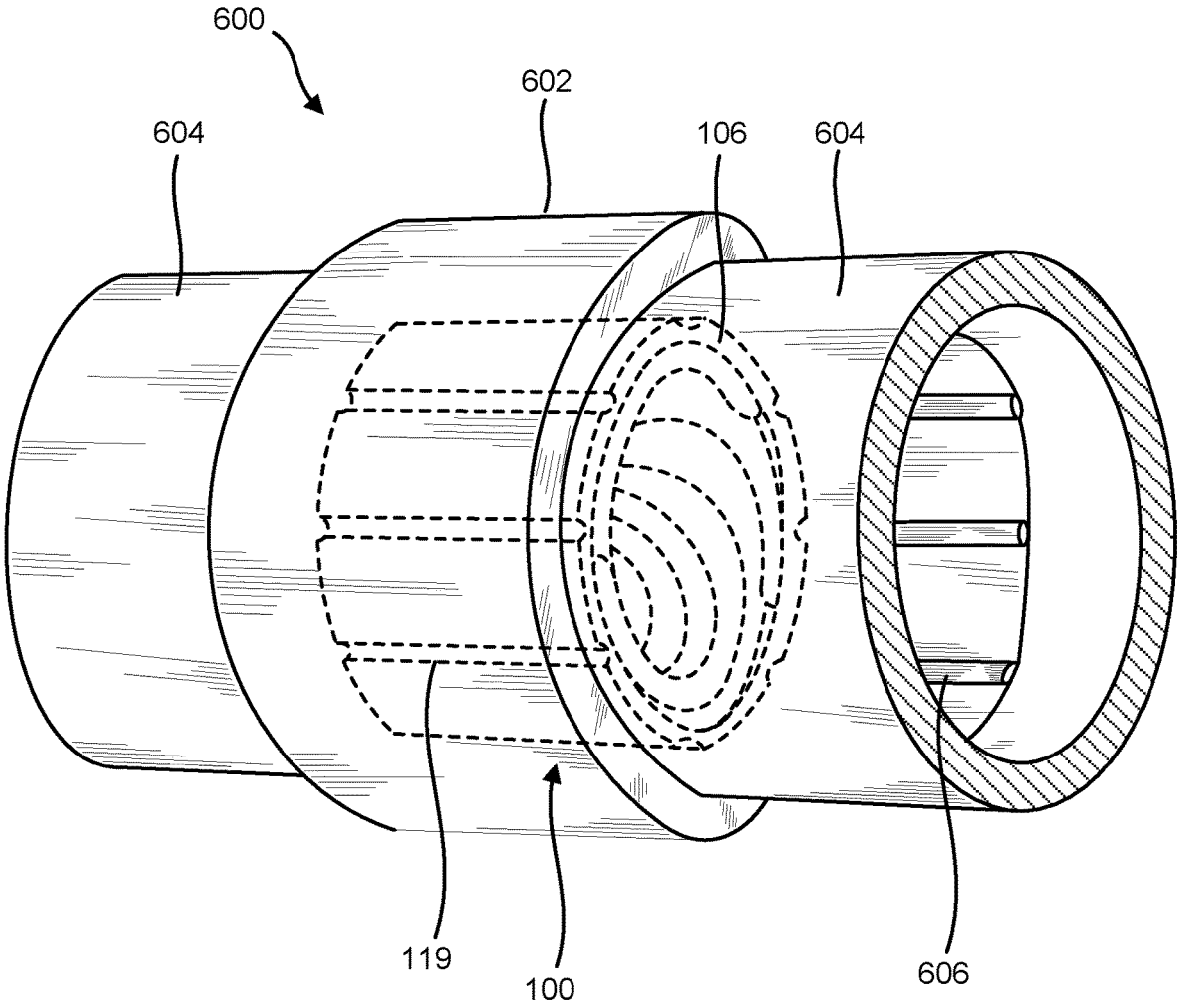
FIG. 6 is a perspective side view of a permanent magnet hollow shaft rotor assembly with a centrifugal impeller assembly.

FIG. 6 is a perspective side view of a permanent magnet hollow shaft rotor assembly 600 with a centrifugal impeller assembly 100. In this embodiment, housing tube 604, magnetic rotary 602, impeller assembly 100 with slots 119, and guide rails 606 are shown.

In this embodiment, housing tube 604 has an outer and inner circumference. The inner circumference further comprises one or more guide rails 606 and housing tube 604 inner circumference is configured to removably attach to impeller assembly's 110 slots 119 located on the outer surface of said impeller assembly. In this embodiment, each of said one or more guide rails 606 are configured to fit into slots 119. In one or more non-limiting embodiments, guide rails 606 hold impeller assembly 100 in place and cause housing tube 604 to rotate when impeller assembly 100 rotates when fluid passes through. In a further embodiment, the impeller assembly has one or more guide rails and the housing tube has one or more slots or another connection method is used.

Additionally, in this view, magnetic rotary 602 is shown. Other types of rotaries may be used such as ball bearings, stators, electrical impulse magnetic fields or any known by those of ordinary skill in the art. The magnetic rotary, in one or more non-limiting embodiments, has an outer circumference and an inner circumference that is made out of bearings and permanent magnets located towards the outer circumference. In this embodiment, when magnetic rotary 602 is attached to housing tube 604, and a motor, generator or other device supplies electricity to the permanent magnets, a magnetic field is created that will rotate the hollow shaft. In this embodiment, the rotating hollow shaft will rotate the centrifugal impeller assembly, because of the bearings, and the permanent magnets will stay in place.

Figure 7:
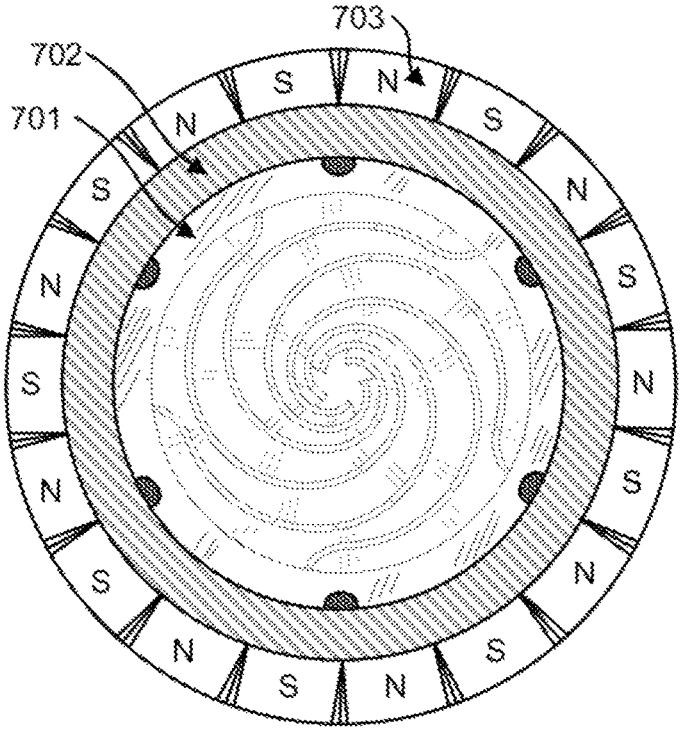
FIG. 7 is a cross-sectional front view of a permeant magnet hollow shaft rotor assembly as shown in FIG. 6

FIG. 7 is a cross-sectional front view of a permeant magnet hollow shaft rotor. In this view, housing tube 702 and magnetic rotary 703 are shown, as well as a centrifugal impeller assembly 701. This figure shows centrifugal impeller assembly 701 attached to housing tube 702.

Figure 8:
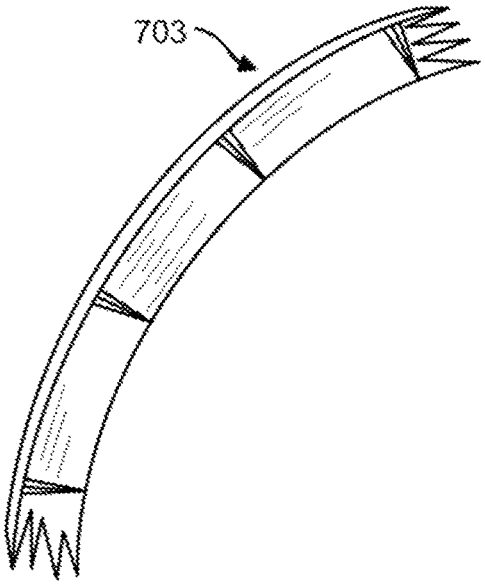
FIG. 8 is an isolated view of the magnetic rotary of FIG. 6.

FIG. 8 is an isolated view of the magnetic rotary of FIG. 6. This close up view shows the magnetic rotary has rotary rings, In one or more non-limiting embodiments, allowing the housing tube to rotate.

Figure 9:
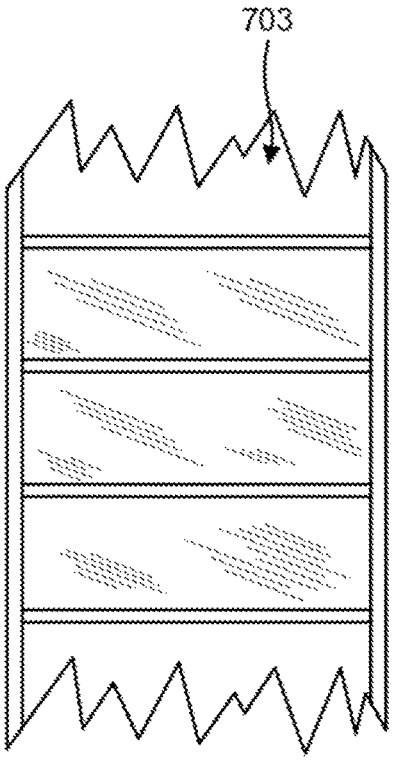
FIG. 9 is a top down view of the magnetic rotary of FIG. 6.

FIG. 9 is a top down view of the magnetic rotary of FIG. 6. This view shows the placement of the magnets in one or more non-limiting embodiments. Further, in one or more non-limiting embodiments, this figure shows the placement of the N and S polarity magnets, and the location of the rotors between said magnets.

It is noted that any of the securing devices shown in FIGS. 1-9 may be formed from any suitable material, even if the cross-hatching used in any of these Figures may be illustrative of a material.

Advantageously, the present description provides one or more embodiments of various types of impeller assemblies. Each impeller assembly depicted herein provides advantages that overcome shortcomings of other types of impeller devices that are used conventionally. Further, the various embodiments shown in the Figures and described herein accommodate different sized impeller assemblies (including single or multi-bladed assemblies) and may be used in various applications, including, but not limited to, movement of fluids. It is noted that the various embodiments of impeller assemblies presented herein may be used in many other ways other than to provide movement of fluids. For example, the various impeller assemblies can be used to provide a shaftless assembly. Thus, the various embodiments described in the present description include a number of novel and helpful components that provide enhanced fluid movement devices to benefit a user.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A centrifugal impeller comprising:

a centrifugal impeller having an outer and an inner circumference, said inner circumference comprising an inlet end and an outlet end, wherein said inlet and outlet ends are substantially perpendicular to said inner circumference; and two or more impeller blades each connected to the inner circumference of the centrifugal impeller and extending continuously from the inlet end of the inner circumference to the outlet end of the inner circumference, each of the two or more impeller blades positioned radially outwardly at the inlet end and extend radially inwardly to the outlet end;

wherein said two or more impeller blades form at least one channel between the two or more impeller blades for compressing a fluid as it travels from said inlet end to said outlet end; and wherein a portion of each of the two or more impeller blades extends outs outwards of the centrifugal impeller's outlet end.

2. The centrifugal impeller of claim 1, wherein each of the two or more impeller blades includes an outlet portion.

3. The centrifugal impeller of claim 2, wherein an edge of each outlet portion forms a wedge shape.

4. The centrifugal impeller of claim 1, wherein the two or more impeller blades include a total of five impeller blades.

5. The centrifugal impeller of claim 1, wherein an edge of said one or more impeller blades forms a wedge shape.

6. The centrifugal impeller of claim 1, further comprising a hollow shaft having an outer circumference.

7. The centrifugal impeller of claim 6, wherein the outer circumference of the hollow shaft includes one or more slots.

8. The centrifugal impeller of claim 7, wherein the hollow shaft is tubular in shape.

9. The centrifugal impeller of claim 8, wherein the one or more slots extend longitudinally along the hollow shaft.

10. The centrifugal impeller of claim 9, wherein the one or more slots includes a total of five slots.

11. The centrifugal impeller of claim 1, wherein the centrifugal impeller is comprised of one or more of the following materials: stainless steel, brass, bronze, carbon fiber, titanium, aluminum, various metal alloys, nylon and plastic.

12. A centrifugal impeller assembly comprising:

a centrifugal impeller having an outer and inner circumference, said inner circumference comprising an inlet end and an outlet end, wherein said inlet and outlet ends are substantially perpendicular to said inner circumference;

two or more impeller blades each connected to the inner circumference of the centrifugal impeller and extending continuously from the inlet end of the inner circumference to the outlet end of the inner circumference, each of the two or more impeller blades positioned radially outwardly at the inlet end and extend radially inwardly to the outlet end, wherein said two or more impeller blades form one or more spirally wrapped channels in between the two or more impeller blades for compressing a fluid as it travels from said inlet end to said outlet end;

and wherein a portion of each of the two or more impeller blades extends outwards of the centrifugal impeller's outlet end; and a hollow shall having an outer circumference comprising one or more slots, wherein said hollow shaft's inner circumference is adaptable to fixedly attach to the outside circumference of the centrifugal impeller.

13. The centrifugal impeller assembly of claim 12, wherein the centrifugal impeller assembly is comprised of a non-magnetic material with metal inserted in the hollow shaft.

14. The centrifugal impeller assembly of claim 12, wherein each of the two or more impeller blades includes an outlet portion positioned at the outlet end of said centrifugal impeller.

15. The centrifugal impeller assembly of claim 14, wherein the one or more outlet blades includes a total of five outlet blades.

16. The centrifugal impeller assembly of claim 14, wherein each outlet portion extends outwards of said centrifugal impeller, wherein the outlet portions are configured for pushing water away from the centrifugal impeller when rotated.

17. A fluid pump, comprising:

a centrifugal impeller assembly comprising:

a centrifugal impeller having an outer and inner circumference, said inner circumference comprising an inlet end and an outlet end, wherein said inlet and outlet ends are substantially perpendicular to said inner circumference;

two or more impeller blades each connected to the inner circumference of the centrifugal impeller and extending continuously from the inlet end of the inner circumference to the outlet end of the inner circumference, each of the two or more impeller blades positioned radially outwardly at the inlet end and extend radially inwardly to the outlet end, wherein said two or more impeller blades form one or more spirally wrapped channels in between the two or more impeller blades for compressing a fluid as it travels from said inlet end to said outlet end;

wherein a portion of each of the two or more impeller blades extends outwards of the centrifugal impeller's outlet end;

a hollow shaft having an outer circumference comprising one or more slots, wherein said hollow shaft's inner circumference is adaptable to fixedly attach to the outside circumference of the centrifugal impeller;

a housing tube having an outer and inner circumference, wherein said housing tube's inner circumference comprises one or more guide rails adapted to removably engage with said impeller assembly's one or more slots; and a magnetic rotary connected to the outer circumference of said housing tube.

18. The fluid pump of claim 17, wherein each of the two or more impeller blades includes an outlet portion positioned at the outlet end of said centrifugal impeller.

19. The fluid pump of claim 17, wherein the magnetic rotary includes a ring including one or more bearings and one or more permanent magnets.

20. The fluid plump of claim 19, wherein the magnetic rotary is configured for rotating the housing tube when electricity is applied.

* * * * *